US006712931B1

(12) United States Patent
Grön et al.

(10) Patent No.: US 6,712,931 B1
(45) Date of Patent: Mar. 30, 2004

(54) METHOD FOR MANUFACTURING A PAPER OR BOARD WEB AND A PAPER OR BOARD MACHINE

(75) Inventors: Johan Grön, Espoo (FI); Pasi Ahonen, Jyväskylä (FI); Juha Kinnunen, Jyväskylä (FI); Pentti Rautiainen, Järvenpää (FI); Mari Taipale, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/570,189

(22) Filed: May 12, 2000

(30) Foreign Application Priority Data

May 12, 1999 (FI) ..... 991095

(51) Int. Cl.[7] ..... D21H 17/67; D21H 19/00; D21H 23/02; D21F 11/00

(52) U.S. Cl. ..... 162/128; 162/183; 162/135; 162/205; 162/158

(58) Field of Search ..... 162/135–137, 162/158, 160, 183–185, 123, 125, 128, 127, 205; 34/414, 398, 400

(56) References Cited

U.S. PATENT DOCUMENTS

| | | | | |
|---|---|---|---|---|
| 4,793,899 A | | 12/1988 | Skaugen | 162/381 |
| 5,262,006 A | * | 11/1993 | Andersson et al. | 162/147 |
| 5,438,920 A | | 8/1995 | Koivukunnas et al. | 100/38 |
| 5,894,679 A | | 4/1999 | Kuhasalo et al. | 34/117 |
| 6,270,624 B1 | * | 8/2001 | Houvila et al. | 162/127 |

FOREIGN PATENT DOCUMENTS

| | | | |
|---|---|---|---|
| EP | 0824157 | | 2/1998 |
| EP | 0 908 557 A1 | * | 4/1999 |
| FI | 981330 | | 11/1999 |
| FI | 981331 | | 12/1999 |
| WO | 9932714 | | 7/1999 |
| WO | 99/40256 | * | 8/1999 |

OTHER PUBLICATIONS

Ein neuer Ansats für das Management des Nasspartie, T. Pekarinen, A. Kunonen, Optified; Wochenblatt Für Papierfabrikation 20, 1998 (pp. 984–988).

1998 TAPPI Proceedings, Coating/Papermakers Conference, Book 2, (pp. 899–914).

"Efficient Forming at High Speeds", L. Verselo; XI Valmet Paper Technology Days 1998 (7 pages).

"Multilayering, Method or Madness?", M.H. Odell, J.S. Kinnunen, XI Valmet Paper Technology Days 1998 (9 pages).

Challenges for Digital Printing Papers, P. Ahonen, XI Valmet Paper Technology Days 1998 (5 pages).

* cited by examiner

*Primary Examiner*—José A. Fortuna
(74) *Attorney, Agent, or Firm*—Steinberg & Raskin, P.C.

(57) ABSTRACT

A method for manufacturing a paper or board web in which stock is fed from a headbox (100) to a wire section (200), in which water is removed from the web (W) and from which the web (W) is passed to a press section (300), in which water is pressed out of the web (W) and after which the web (W) is dried in a dryer section (400) and reeled by means of a reel-up (800). According to the invention, additives, fillers and/or fines are fed into the stock of the surface layers of the web (W) in order to reduce the pore size distribution of the web in the surface layers so as to substantially correspond to a precoated web. The invention also relates to a paper or board machine which is characterized in that it is structured for enabling the feeding of additives, fillers and/or fines into a fiber stock such that an uncoated web substantially corresponds in its properties to a precoated web.

11 Claims, 2 Drawing Sheets

METHOD FOR MANUFACTURING A PAPER OR BOARD WEB AND A PAPER OR BOARD MACHINE

FIELD OF THE INVENTION

The invention relates to a method and devicie for manufacturing a paper or board web, and in particular, a method and device for producing an uncoated web which substantially corresponds in its properties to a precoated web.

BACKGROUND OF THE INVENTION

The method and the paper or board machine according to the invention can be applied very widely in the manufacture of different paper and board grades in which the conventional method would comprise improving the quality of paper or board by precoating. Typical such writing and printing papers are fine paper, LWC base paper or improved newsprint known by a person skilled in the art. The coating of different board grades has also increased in recent years. Hereafter, the invention will, however, be described mainly in connection with the manufacture of fine paper. However it is appreciated that the invention is not confined to this to this area In this description, the use of the term fine paper is intended to mean uncoated fine paper and coated fine paper. The basis weight of uncoated fine paper is usually 40 to 230 g/m$^2$ and that of coated fine paper 60 to 250 g/m$^2$. Typical pulp for manufacturing fine paper comprises chemical fibres: short fibres which are obtained, for example, from birch and an eucalyptus tree, and a long-fibre material obtained from softwood trees is generally added thereto.

The proportion of mechanical pulp is generally below 10%. About 15 to 30% of filler is added to the pulp, and the filler may be stone, calcium carbonate, kaolin and/or other suitable mineral pigments. Recently, in the manufacture of fine paper, increasing use has also been made of recycled fibres.

As mentioned above, by means of the method and the paper machine in accordance with the invention, it is possible to manufacture profitably paper that corresponds to precoated fine paper. In this application, the aim of conventional precoating has been to provide the surface of the web with certain properties which are beneficial in the further processing of the web. These properties include, among other things, a desired porosity of and pore size distribution in the surface as well as a desired oil absorption level, for example, measured by the Cobb-Unger method. The coverage degree of pigment is also one property that is monitored. The process of manufacturing fine paper according to the invention, which does not apply conventional precoating, thus enables said properties to have values which correspond to those attained when using a conventional manufacturing process that includes a precoating stage.

Corresponding to coated fine paper, the invention can also be applied advantageously to paper grades containing mechanical pulp, which paper grades are coated at the final stage of the manufacturing process. Typical such paper grades are LWC and MWC.

The method and the device according to the invention also make it possible to manufacture better newsprint than before without adding a surface sizing unit to a line. The significance of the invention in this application will be the greater, the faster the newspaper machines will be and the thinner the newsprint will become. Four-colour printing requires a surface that is stronger and denser than before. As known, it has been taught previously that this is attained by surface-treatment of the web.

It is required more and more often that boards shall have a better printing surface than before. Our invention offers good possibilities for that without costly investments at the dry end of the board machine. When multi-layer boards are manufactured, our invention also offers an advantageous solution for improving the printing properties of webs forming the surface layers of multi-layer board. The bonding strength of multi-layer board can also be increased by feeding, for example, starch into the surface of the webs.

In paper or board machines known in prior art, the short circulation and other stock systems are most commonly built such as to mix fibres, fillers, fines and additives to form a stock that is as homogeneous as possible in order to be supplied into a headbox of a paper or board machine. In multi-layer web forming, it is also known to use several different stock systems for feeding different fibre suspensions either into one or more headboxes. The headbox spreads the formed pulp suspension evenly on a wire section, in which dewatering and couching of the web begin. In prior art there are known several different types of wire sections, or formers, known in themselves to a person skilled in the art; fourdrinier formers, hybrid formers, and gap formers. Board machines may include even several wire units. From the standpoint of the invention, the most preferable former is a gap former, in which a slice jet produced by a headbox is fed between two wires and the bulk of the water is removed between said wires in two directions. One advantageous gap former arrangement has been described in the paper L. Verkasalo: Efficient Forming at High Speeds, XI Valmet Paper Technology Days 1998. In the arrangements known from prior art, the fibre and filler distribution in the thickness direction of the web can be controlled only to a limited degree, for example, by placement and vacuums of the dewatering elements of the former. The fillers often accumulate on the surfaces of the web in dewatering stages.

In prior art there are known in themselves multi-layer headboxes, some of them being described, for example, in the paper M. Odell: Multilayering, Method or Madness?, XI Valmet Paper Technology Days 1998 and in FI patent 92 729, and one of them being also described in the paper P. Ahonen: Challenges for Digital Printing Paper, XI Valmet Paper Technology Days 1998. Multi-layer headboxes allow desired layer structures to be produced in the web by feeding stock in layers between wires. Instead of multi-layer headboxes, in the case of some board grades in particular, several different headboxes and wire units have been used in order to provide a layered structure.

The web is passed from the wire section to a press section where water is removed from the web by pressing it against one or two felts. A person skilled in the art knows several different press arrangements from prior art, for example, a press based on roll nips, marketed by the applicant under the trademark SymPress™II. Recently, instead of roll nips, ever-increasing use has been made of an extended nip known in itself in prior art because of its higher dewatering capacity and/or its ability to retain the bulk of the web.

The dryer section in prior-art paper and board machines has most commonly been formed of a dryer section which uses a conventional single- and/or twin-wire draw and in which drying takes place mainly as cylinder drying while the wire presses the web against a heated cylinder surface. At high running speeds, single wire draw through the entire dryer section has become common in recent years. As the most recent arrangement, for example, the patent application PCT/FI98/00945 has proposed combining impingement drying with cylinder drying in order to provide a higher evaporation rate and a shorter dryer section.

In some prior-art arrangements, the paper web is passed from a dryer section to a precalender, which in known arrangements may be a calender with hard or soft nips, in which the paper web is passed through the nip between rolls to provide smoothness to the surface of the paper web. In the precalender, loose fibres and other components of stock are also fixed to the surface of the web, but, at the same time, differences in density may also be caused in the base paper and some of the bulkiness of the web important to many grades may be lost. Precalendering is particularly important before the coating of the web when blade coating is used in order to avoid so-called blade lines.

In surface sizing, the surfaces of the web are treated with a starch or pigment solution in a film size press, for example, by means of an applicator device marketed by the applicant under the trade name SymSizer™. Surface sizing, pigmenting, or coating is performed at this stage typically on both sides of the web at the same time, but the surfaces of the web can also be treated separately in successive units. After that, the paper web is dried by using infrared dryers and airborne web-dryers and a short cylinder group which follows them.

After that, as known in prior art, the web is coated by means of blade, roll or jet coating units known in themselves in prior art and dried by using infrared and airborne dryers as well as cylinder drying. The dried paper or board web is reeled, which is followed by a multi-nip calender which provides a desired smoothness and gloss level to the paper. Recently, on-machine calendering has also become common.

On the other hand, in arrangements known in prior art, the dryer section is often followed by a calender and a reel-up. After that, there is placed an unwind stand, from which the web is passed to an off-machine coating station. Different coating stations are known from prior art. In one known arrangement, one side of the paper web is precoated first, after which there is a dryer section, and after that the other side of the paper web is precoated, which is followed by a dryer section. The coating of the thus produced precoated web is completed by coating it with other coating layers and, after that, the web is dried, and wound up. This is followed by unwinding and calendering and winding up of the web. Thus, the remaining machine after the dryer section may be an on- or off-machine.

Before coating, as known in prior art, the paper can be very porous, and thus after the dewatering and drying treatments it is necessary to precoat the paper web before the surface-coating proper. Also, as a result of this, the paper web must be dried after the precoating process in order that the coating layer proper may be added to the surface of the paper web. The equipment and the web transfers required by these stages considerably increase the length of the fine paper manufacturing line. The aim of this double coating of fine paper, i.e. the precoating and the coating proper, has been to attain a physically and visually uniform coated paper surface for a printing base. The most important function of the precoating layer in said coating process is to reduce the pores present in the surface structure of the base paper in a suitable manner in order that the surface coating layer shall remain on the surface and shall not be absorbed into the structure of paper. If the coating material is distributed very unevenly on the surface of paper, then also after surface-coating, the paper is uneven and it may exhibit, for example, patchiness of gloss or another type of visual defect. For example, by means of a film transfer technique it is possible to attain a uniform coating layer and thereby good coverage, which is a desired property specifically at the precoating stage, since a uniform precoating is required for providing a uniform surface coating. After precoating, the web is surface-coated in prior art, for example, by means of blade coating in order to attain a smooth surface. This, however, sets space demands for the paper finishing line, because the paper is coated in three to four separate stages as the different sides of the paper web are often coated in different stages.

In prior-art paper and board machines, a size press or a coater of the film transfer type is thus generally used for the precoating of the web. In that connection, surface size or an equivalent coating substance in water solution is applied to both sides of the paper web in one or two stages with the purpose of binding fines and fibres to the surface of the web and thereby creating favourable conditions for possible after-coating. In prior-art arrangements, which thus comprise a separate precoater, one problem is that the length of the paper or board machine or of the coating line increases. This increases the investment costs of both the machine itself and the building too. In rebuilds, lack of space may sometimes be a real obstacle to the introduction of new technology. When an aqueous substance is applied to the web, drying is needed, which not only increases the length of the machine and investment costs but also increases the demand for drying energy. Moreover, the paper machine must be provided with open draws, which may cause web breaks and other runnability problems, in particular in the case of lighter weight paper grades and with high running speeds.

With respect to the prior art related to the invention, reference is also made to the applicant's FI patent applications 981330 and 981331. In these, FI patent application 981330 discloses an integrated paper machine by which paper of good quality can be manufactured with high efficiency at a speed exceeding 2000 m/min, and which is shorter than present paper machines. FI patent application 981331 discloses a paper machine which is intended in particular for the manufacture of paper which has copy paper properties as well as a good gloss and a suitable porosity for colour powder printing.

OBJECTS AND SUMMARY OF THE INVENTION

A specific object of the invention is to lower investment costs by providing a paper and board machine that is shorter than known arrangements for the manufacture of paper and board grades which traditionally require precoating.

In accordance with the invention, layering of additives and fillers is used in a headbox instead of precoating carried out in a finishing section in order to reduce the pore size distribution in the surface layers of a paper web. When additives and/or fillers are introduced into the surface layers of stock, it is possible to provide, for example, a U-shaped thickness direction profile of the filler. In layering additives and fillers, the stock is divided into three different stock flows for surface layers and for a middle layer, each of which is supplied with desired additives and fillers, starch in particular, in order to provide different layer structures. When needed, additives and fillers can be fed into the stock flow from several different points or in several different stages. In accordance with an advantageous embodiment of the invention, fines can also be added. Moreover, in connection with the invention, it is possible to advantageously use layering of fibres, in which fibre stock is divided into separate components for the surface and middle layers such that a desired type of fibre stock is passed to a surface layer and to a middle layer, respectively. In addition, it is possible to use retention agents which bind the fillers and fines to the surface, which prevents them from being carried away from the surface layers along with water. The retention agent may also be supplied in layers.

In other words, in accordance with the invention, surface sizing, pigmenting or precoating, depending on the web that is being manufactured, is integrated into the initial portion of a paper or board machine, and additives and fillers are already introduced into the surface of the web immediately at the initial stage of the manufacture of the web. Thereby, a sufficiently small pore size is produced so that the coating proper shall remain in the surface. Thereby, a surface advantageous to printing processes is also produced, from which surface printing ink does not penetrate deep into the web.

The invention enables a pore size of the paper surface to be achieved which is 1/10 of its original value. Optimum coating coverage is attained when the pores in the base paper are so small that the coating does not penetrate into them, thus remaining on the surface. This is attained by already adding in the headbox additives and fillers to the stock flows which are passed to the surface layers and advantageously by using the layering of fibres at the same time and possibly by adding fines to the stock flows which are passed to the surface layers.

In accordance with an advantageous embodiment, when the layering of fibres is used, for example, when manufacturing paper with a basis weight of 80 g, the layers can be layers of 20, 40, 20 g/m$^2$ of equal consistency. The invention also encompasses fibre layer a arrangements in which stocks of consistencies differing from one another are supplied to the different layers.

In the invention, precoating has thus been replaced with the layering of additives and fillers, whereby the efficiency of the process is improved and investment costs are reduced. The paper machine in accordance with the invention, in which precoating has been replaced with a technique for layering additives and fillers, comprises according to an advantageous embodiment a multi-layer headbox, a gap former, a press section, a dryer section, a surface coating station/stations and a multi-nip calender as well as a reel-up.

A saving of about 20% in apparatus costs and a saving of about 20% in hall costs are achieved by means of the paper machine in accordance with the invention.

Savings are also obtained because of on-line arrangements, in which connection the number of operating personnel can be reduced, and it is also possible to achieve savings of energy and water consumption as well as other savings, for example, a reduced amount of broke.

In the arrangement in accordance with the invention, benefits in bulk and opacity are also attained. The benefit in bulk is achieved because precalendering compresses the web, raising its density. The opacity of paper deteriorates if the surface is porous and the coating penetrates into the paper.

The method according to the invention applies a short circulation and a headbox which allows layering of additives, fillers and/or fines. One stock feed system advantageously applied in the invention is disclosed in FI patent application 934793. Fillers, fines and additives can also be supplied only in the headbox itself. One such arrangement is described in EP patent publication 824157. The short circulation arrangements may be arrangements already known in themselves in prior art, but it is particularly beneficial to apply in connection with the invention the short circulation marketed by the applicant under the trademark OptiFeed™, which is described, among other things, in the magazine article Ein Neuer Ansatz für das Management der Nasspartie, Wochenblatt für Papierfabrikation, vol. 19, No. 20, October 1998. By using the OptiFeed™ arrangement, the stock volumes of the short circulation are minimized, wherefore, for example, a change of grade can be performed quickly by means of the paper or board machine in accordance with our invention without long disturbances, for example, in the composition of stock.

The paper or board machine in accordance with the invention thus includes a short circulation and a headbox which allow the layering of at least fillers. A gap former is preferably used as a former, the gap former allowing higher speeds than other types of formers and enabling dewatering on both sides, whereby symmetric paper is obtained. As one such gap former, for example, the wire section marketed by the applicant under the trademark OptiFormer™ or a corresponding type of former can be mentioned, one former of this kind having being described in said paper L. Verkasalo: Efficient Forming at High Speeds, XI Valmet Paper Technology Days 1998.

Known press arrangements can be utilized in the paper or board machine in accordance with the invention, but in many cases it is most beneficial to use extended nip pressing. Good bulk and high dry solids as well as minimum asymmetry are provided to the web by means of a so-called shoe press. When using, for example, the applicant's double-felted OptiPress™ press section, symmetric dewatering and a web with symmetric surface properties are obtained. When high dry solids are aimed at, it may be beneficial to replace one felt with a water-non-receiving fabric that transfers the web well, with a so-called transfer belt. Even though the invention substantially reduces the need for separate coating devices, in some applications it may be beneficial to combine surface sizing/pigmenting with the press section, in which connection a separate surface sizing/pigmenting unit after the dryer section and further treatments associated therewith are not necessarily needed. One such arrangement (wet end sizing) is described, for example, in U.S. Pat. No. 4,793,899.

The invention does not set any special demands for the dryer section, but in connection therewith it is possible to apply prior art drying arrangements, for example, a dryer section which applies single-wire draw and with which impingement drying may be additionally combined for the purpose of providing drying capacity, profiling or a quick change of grade. Such a modem dryer section is disclosed, among other things, in international patent application PCT/FI98/00945. In the case of paper grades in particular it is beneficial to use a dryer section marketed by the applicant under the trademark OptiDry™ or a corresponding type of dryer section. When desired, precalendering can be used in the dryer section, such precalendering being described, for example, in FI patent application 960925 which discloses calendering against a drying cylinder. Of course, precalendering can also be accomplished between two rolls. Naturally, when needed, precalendering can also be accomplished traditionally after the dryer section.

The end portion of the paper machine in accordance with the invention does not include precoating because coating has been accomplished in the headbox, in which connection fillers and/or starch have been layered, nor does it include surface sizing/pigmenting except possible wet end surface sizing/pigmenting in the press section. Thus, on coming from the dryer section proper, paper is surface-coated in one or more surface coating stations, which is/are followed by an on- or off-line multi-nip calender.

In those embodiments of the invention in which the web is further coated separately in a coating station, for example, a blade coater, a coating device of the jet, film transfer or spray type is used in the coating process. A coating agent is transferred by means of the coating device freely to the surface of the web either as a continuous jet (jet) or as drops (spray) or the coating agent is applied by a roll. Advantageously, for example, a coating device marketed by the applicant under the trademark OptiCoat Jet™ or a corresponding type of coating device is used. In the coating process, it is also possible to use advantageously a film transfer technique, for example, a coating device marketed by the applicant under the trademark SymSizer™ or OptiSizer™.

In order to eliminate web breaks, the web may be coated while supported by a belt. Supported coating is described, for example, in the applicant's Finnish patent FI 101489 as well as in the article 1998 Coating/Paper Machine Makers Conference, TAPPI Proceedings.

The drying after coating is started as contact-free drying, for example, by means of a dryer marketed by the applicant under the trademark PowerDry™ or by means of an equivalent type of dryer, which provides a high drying capacity and, when needed, a quick change of drying capacity. In actual fact, contact-free drying is often the principal form of drying so that the short cylinder group following after it functions mainly as a drive group. After that, there is advantageously a multi-nip calender, which is preferably an on-line calender marketed by the applicant under the trademark OptiLoad™ or a corresponding type of calender, which differs from conventional supercalenders in that its linear loads in each nip can be regulated separately. By this means, it is possible to regulate bulk, yet attaining good gloss and smoothness. With respect to this type of calender, reference is made to FI patent 96334. In connection with the invention, it is, of course, also possible to apply off-machine calenders.

After that, there is a reel-up, preferably a reel-up marketed by the applicant under the trademark OptiReel™ or a reel-up of a type that is suitable for even reeling of the web.

By means of the method in accordance with the invention it is possible to manufacture paper or board which corresponds to a web manufactured by a machine provided with a precoating unit in accordance with prior art. However, differing from prior art, the paper or board machine in accordance with the invention does not comprise a precoating unit. Moreover, according to an advantageous embodiment of the invention, no surface sizing/pigmenting unit is needed, and advantageously there is no need for a precalender, either.

In connection with the invention, it shall be particularly noted that several of the techniques used in the method and in the paper machine in accordance with the invention have become known separately only quite recently.

BRIEF DESCRIPTION OF THE FIGURES

In the following, the invention will be described in more detail with reference to the figure in the accompanying drawing, to the details of which the invention is, however, not by any means intended to be narrowly confined. The figure is closely related to a fine paper machine. Nevertheless, the invention is not intended to be limited only to this embodiment which is advantageous in itself.

DETAILED DESCRIPTION OF THE INVENTION

Figure 1:
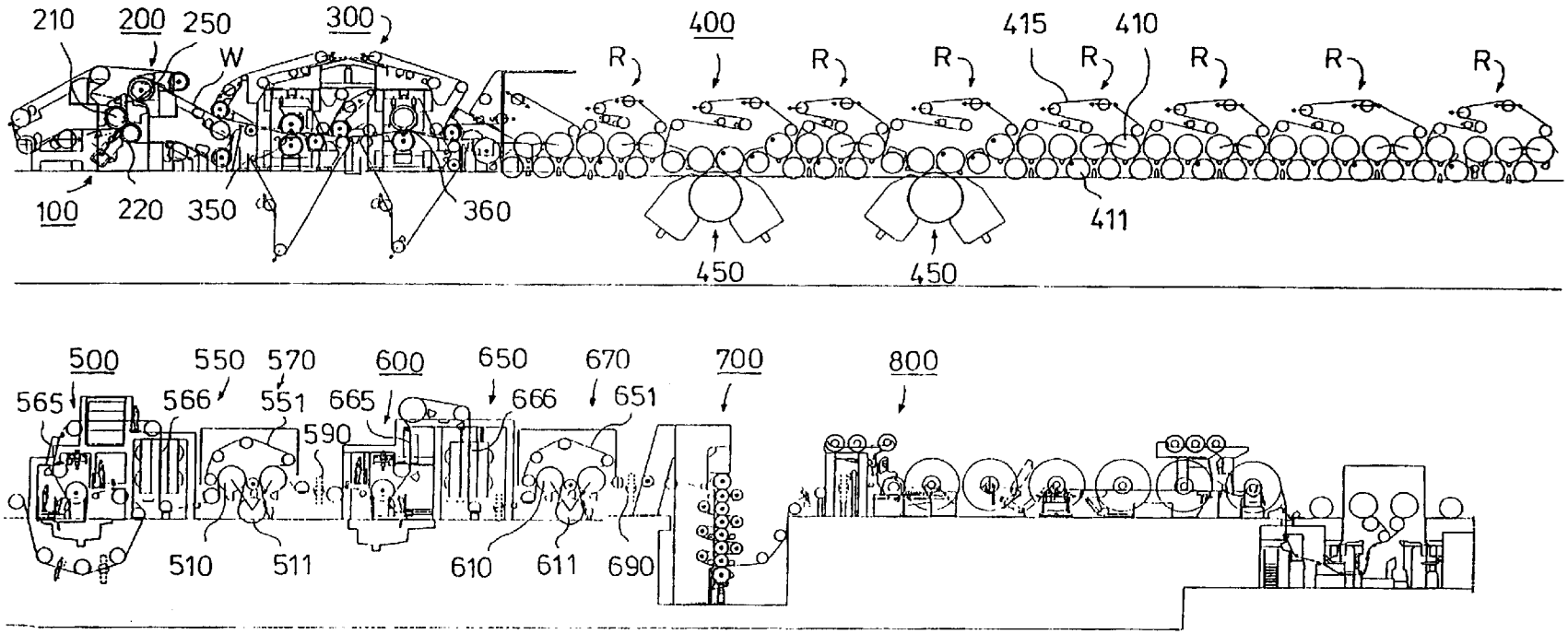
FIG. 1 is a schematic view of one embodiment of the paper machine according to the invention.

As shown in FIG. 1, stock is fed from a headbox 100 to a wire section 200, in which there is a gap former 250 which removes water on two sides and which is followed by a press section 300. In the press section 300, at least one press is an extended nip press, advantageously a shoe press, which conserves bulk and reduces two-sidedness in dewatering of paper. In the press section shown in the figure, a first press nip is a roll nip 350 and a second nip is an extended nip 360. The web W is passed from the press section 300 to a dryer section 400, in which single-wire draw groups R and impingement drying 450 are used in the application illustrated in the figure. The web W is coated in coating stations 500, 600, after which the web W is dried in dryer portions 550, 650 using principally infrared dryers 565, 665 and airborne dryers 566, 666. This contact-free drying 550, 650 is followed by a short cylinder group 570, 670, in which the draw and tension of the web are accomplished, drying the web further at the same time. After that, the web is calendered in a multi-nip calender 700, in which the linear load in each nip can be advantageously regulated separately. After that, the web is passed to a reel-up 800 in which the web is wound into reels.

In accordance with the invention, the headbox 100 is a multi-layer headbox in which the stock is layered such that the stock flows passed to the surface layers comprise fillers and additives, for example, starches, and a retention agent, if any. In addition to the layering of additives and fillers, it is possible to layer, when needed, fines into the surface layers or to use the layering of fibres at the same time. If it is beneficial from the standpoint of the end product, the arrangement also allows feeding of the necessary additives and other similar substances into the middle layer as well.

In the paper machine illustrated in the figure, the travel of the paper web W is as follows. The stock is fed from the headbox 100 into a gap between forming rolls 210, 220 of the gap former 250 of the wire section 200, from which gap it is passed between wires via the dewatering devices of the gap former 250 further to the press section 300 while supported by a wire. The press section 300 comprises two presses 350 and 360, and the web W is passed on an upper fabric of the first press 350, while supported by a lower fabric, so as to be between the press rolls of the press 350. From the lower fabric, the web W is passed onto an upper fabric of the next press 360 and further between the upper fabric and a lower fabric so as to be between the press rolls of the press 360. The web W is passed from the press section 300 to the dryer section 400, in which the web W is dried, while supported by drying wires, in impingement drying groups 450 and in drying groups R that apply single-wire draw. In the drying groups R applying single-wire draw, the reference numeral 415 designates the drying wire and the reference numeral 410 designates heated drying cylinders in an upper row and the reference numeral 411 designates reversing cylinders or rolls in a lower row. The web W runs meandering from the reversing cylinders/rolls 411 of the lower row onto the heated drying cylinders 410 of the upper row, on which the web W is in direct contact with the heated cylinder surface. For the sake of clarity, the above-noted signs have been indicated only in connection with one drying group R. After that, the web W is coated in the coating stations 500, 600, in which the web is passed from the coating station 500, 600 into the drying equipment 550, 650 which apply contact-free drying, said drying equipment being followed by a drying group 570, 670 applying single-wire draw and comprising a drying wire 551, 651, heated drying cylinders 510, 610 and reversing cylinders/rolls 511, 611. In addition, a measuring device 590, 690 has been placed after each coating station 500, 600. After that, the web W is passed to the calender 700, which has been formed as a multi-nip calender. After the calender 700, the web W is passed to the reel-up 800, in which the paper web W is wound into paper reels.

Figure 2:
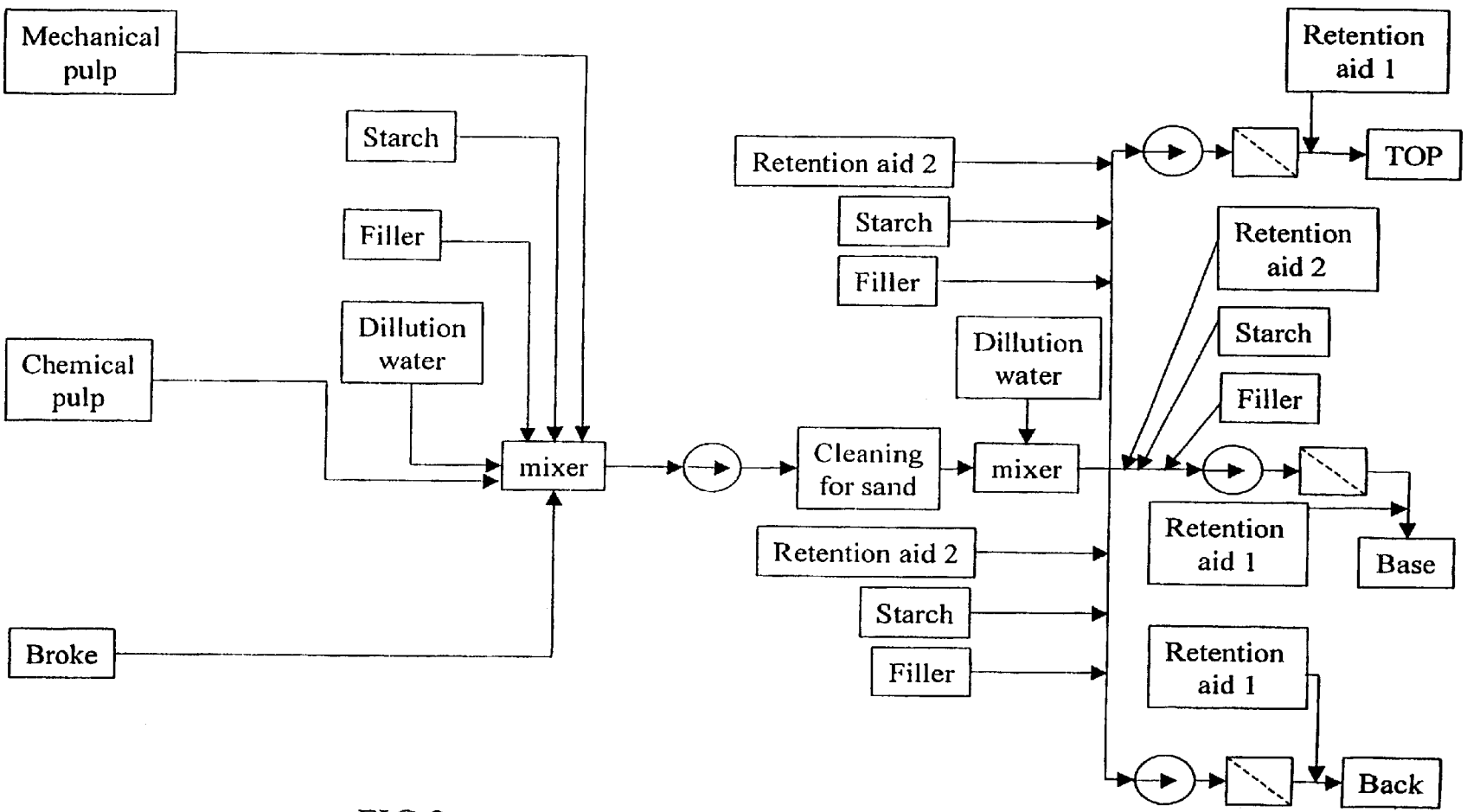
FIG. 2 is a schematic view of a short circulation arrangement in accordance with the invention when stock contains several different fibre components, for example, mechanical and chemical pulp.

The layering of additives known from FI patent 934793 and a new simplified short circulation concept, OptiFeed, can be utilized in the invention. FIG. 2 schematically shows one short circulation arrangement that can be advantageously applied in connection with the invention in the case that the stock contains several different fibre components, for example, mechanical and chemical pulp, as in FIG. 2. Of course, the pulp may also be a pulp that is based on recycled fibres. As shown in the figure, the different pulp components are passed in a desired ratio into a mixer (Mixer), which is also supplied with dilution water and possibly with some of the fillers (Starch and Filler). The stock is cleaned and dilution water is added thereto in a mixer of the next stage. After that, the stock is divided into three different lines in order to be passed through a pump and a screen into different layers of a headbox of a paper or board machine or into different headboxes of a multi-layer former. In each line, additives, fillers and fines, including retention agents, required in the layer in question are added to the stock. Depending on the application, the amount of these additives may be different in each line.

The operativeness of the invention has been tested by the applicant on a pilot machine scale. A web was manufactured from a commercial fine paper pulp by means of a paper machine according to the invention, including, among other things, a multi-layer headbox, an OptiFormer gap former and an OptiPress press, which web was then surface-coated by the jet technique and calendered in an OptiLoad multi-nip calender before sheet offset printing. As reference paper, fine paper was manufactured in a traditional manner such that about 20% of PCC had been added homogeneously to the pulp as a filler. This reference paper was also precoated in a conventional manner by a SymSizer surface sizing unit before the surface coating proper. This paper was compared with a fine paper which was manufactured in accordance with the invention by layering PCC filler into the surface layers of the web. This web was surface-treated directly without any precoating stage. Among other things, the uniformity of the print quality of printed sheets was measured as graininess and mottle. No substantial difference could be observed between the different manufacturing methods. The gloss of print, Hunter 75°, was also measured. Here, the paper that had been manufactured in a traditional manner proved to provide a printing surface that was slightly glossier than that of the paper made by the method of the invention. A trial run did not reveal any two-sidedness problems in non-precoated sheets.

Above, the invention has been described with reference to only one of its advantageous embodiments, to the details of which the invention is, however, not intended by any means to be narrowly confined. Many variations and modifications are feasible within the inventive idea defined in the following claims.

What is claimed is:

1. A method for manufacturing a coated paper or board web comprising the steps of:

providing a multi-layer headbox in which a stock is separated into a plurality of different stock flows, at least one of said plurality of different stock flows being a surface layer stock flow;

feeding into said surface layer stock flow stock additives, fillets and/or fines for reducing the pore size distribution of the paper or board web in the surface layers of the web;

feeding the plurality of stock flows, including said surface stock flow, from said multi-layer hand box to a wire section in which water is removed from the web;

feeding the web from the wire section to a press section to press water out of the web;

drying the web in a dryer section so that after said dryer section the web has a pore size distribution corresponding to that of a precoated web;

transferring the web to a coating station after said drying section where the web is coated; and reeling the web by means of a reel-up.

2. A method according to claim 1, further comprising the step of layering fibers into said surface layer stock flow.

3. A method according to claim 1, further comprising the step of passing into said surface layer stock flow a retention agent in order to bind the additives and fillers to the surface of the web.

4. A method according to claim 1, further comprising the step of removing water flow from the web in to directions in a gap former.

5. A method according to claim 1, further comprising the step of pressing water out of the web in the press section in at least one extended nip press.

6. A method according to claim 1, further comprising the step of surface sizing/pigmenting of the web in the press section.

7. A method according to claim 1, wherein the drying of the web in the dryer section is performed by means of impingement dying.

8. A method according to claim 1, further comprising the step of coating the web in a coating station, and drying the web after coating by means of contact-free drying.

9. A method according to claim 1, further comprising the step of coating the web in a coating station using a film transfer technique.

10. A method according to claim 8, wherein the web is supported by means of belts in the coating station of the paper or board machine.

11. A method according to claim 1, further comprising the step of calendering the web in a multi-nip calender and regulating the liner load separately in each nip.

* * * * *